US008798301B2

(12) United States Patent
Shennib et al.

(10) Patent No.: US 8,798,301 B2
(45) Date of Patent: Aug. 5, 2014

(54) TOOL FOR REMOVAL OF CANAL HEARING DEVICE FROM EAR CANAL

(75) Inventors: Adnan Shennib, Oakland, CA (US); Victor Valenzuela, Hayward, CA (US); Patrick Contioso, Sunnyvale, CA (US)

(73) Assignee: Ihear Medical, Inc., San Leandro, CA (US)

( * ) Notice: Subject to any disclaimer, the term of this patent is extended or adjusted under 35 U.S.C. 154(b) by 233 days.

(21) Appl. No.: 13/461,327

(22) Filed: May 1, 2012

(65) Prior Publication Data

US 2013/0294631 A1 Nov. 7, 2013

(51) Int. Cl.
*H04R 25/00* (2006.01)
*H04R 25/02* (2006.01)

(52) U.S. Cl.
CPC ..... *H04R 25/65* (2013.01); *H04R 25/556* (2013.01); *H04R 2460/17* (2013.01); *H04R 2225/023* (2013.01)
USPC ..... 381/329; 181/130

(58) Field of Classification Search
CPC .. H04R 25/556; H04R 25/65; H04R 2460/17; H04R 2225/023
USPC ..... 381/329; 181/130, 135
See application file for complete search history.

(56) References Cited

U.S. PATENT DOCUMENTS 5,327,500 A 7/1994 Campbell
5,553,152 A 9/1996 Newton
5,645,074 A 7/1997 Shennib et al.
5,659,621 A 8/1997 Newton
5,701,348 A 12/1997 Shennib et al.
5,785,661 A 7/1998 Shennib et al.
6,137,889 A 10/2000 Shennib et al.
6,212,283 B1 4/2001 Fletcher et al.
6,359,993 B2 3/2002 Brimhall
6,367,578 B1 4/2002 Shoemaker
6,382,346 B2 5/2002 Brimhall et al.
6,473,513 B1 10/2002 Shennib et al.

(Continued)

FOREIGN PATENT DOCUMENTS

WO WO-99/07182 A2 2/1999

OTHER PUBLICATIONS

"Lyric User Guide", http://www.phonak.com/content/dam/phonak/b2b/C_M_tools/Hearing_Instruments/Lyric/documents/02-gb/Userguide_Lyric_V8_GB_FINAL_WEB.pdf, Jul. 2010.
"User Manual—2011", AMP Personal Audio Amplifiers.

*Primary Examiner* — Jesse Elbin
(74) *Attorney, Agent, or Firm* — Dorsey & Whitney LLP

(57) ABSTRACT

A removal tool for removing canal hearing devices from the ear canal, examples of which may include a hand piece and a removal loop having a wide section for placing over a knob handle structure incorporated within the canal hearing device, and a narrow section for interlocking with the knob handle to remove the hearing device from the ear. The removal loop is generally configured in the shape of keyhole to guide and transition of the knob and shaft of the knob handle into the narrow section for capture and interlocking therewithin. The removal tool may provide ease of use, particularly for individuals with poor dexterity and/or poor vision. In a preferred embodiment, the removal loop is made of a single formed wire for improved durability, lower cost of fabrication, and safe operation that minimizes contact with the walls of the ear canal.

28 Claims, 10 Drawing Sheets

(56) References Cited

U.S. PATENT DOCUMENTS

| | | | | |
|---|---|---|---|---|
| 6,546,108 | B1 | 4/2003 | Shennib et al. | |
| 6,724,902 | B1 | 4/2004 | Shennib et al. | |
| 6,937,735 | B2 | 8/2005 | DeRoo et al. | |
| 6,940,988 | B1 | 9/2005 | Shennib et al. | |
| 7,016,511 | B1 | 3/2006 | Shennib | |
| 7,113,611 | B2 | 9/2006 | Leedom et al. | |
| 7,215,789 | B2 | 5/2007 | Shennib et al. | |
| 7,260,232 | B2 | 8/2007 | Shennib | |
| 7,298,857 | B2 | 11/2007 | Shennib et al. | |
| 7,310,426 | B2 | 12/2007 | Shennib et al. | |
| 7,321,663 | B2 | 1/2008 | Olsen | |
| 7,403,629 | B1 | 7/2008 | Aceti et al. | |
| 7,424,123 | B2 | 9/2008 | Shennib et al. | |
| 7,424,124 | B2 | 9/2008 | Shennib et al. | |
| 7,580,537 | B2 | 8/2009 | Urso et al. | |
| 7,664,282 | B2 | 2/2010 | Urso et al. | |
| 8,155,361 | B2 | 4/2012 | Schindler | |
| 8,184,842 | B2 | 5/2012 | Howard et al. | |
| 8,467,556 | B2 | 6/2013 | Shennib et al. | |
| 8,571,247 | B1 * | 10/2013 | Oezer | 381/329 |
| 2001/0008560 | A1 | 7/2001 | Stonikas et al. | |
| 2002/0027996 | A1 | 3/2002 | Leedom et al. | |
| 2002/0085728 | A1 | 7/2002 | Shennib et al. | |
| 2005/0249370 | A1 * | 11/2005 | Shennib et al. | 381/329 |
| 2005/0259840 | A1 | 11/2005 | Gable et al. | |
| 2005/0283263 | A1 | 12/2005 | Eaton et al. | |
| 2006/0291683 | A1 | 12/2006 | Urso et al. | |
| 2010/0040250 | A1 | 2/2010 | Gerbert | |
| 2010/0119094 | A1 | 5/2010 | Sjursen et al. | |
| 2010/0239112 | A1 | 9/2010 | Howard et al. | |
| 2011/0058697 | A1 | 3/2011 | Shennib et al. | |
| 2011/0188689 | A1 | 8/2011 | Beck et al. | |
| 2011/0206225 | A1 * | 8/2011 | Moller et al. | 381/329 |
| 2013/0010406 | A1 | 1/2013 | Stanley | |
| 2013/0243229 | A1 | 9/2013 | Shennib et al. | |
| 2014/0003639 | A1 | 1/2014 | Shennib et al. | |

* cited by examiner

TOOL FOR REMOVAL OF CANAL HEARING DEVICE FROM EAR CANAL

TECHNICAL FIELD

Examples described herein relate to hearing devices, and include particularly hearing devices that are positioned in the ear canal for inconspicuous wear. This application is related to pending patent applications Ser. No. 12/878,926, titled CANAL HEARING DEVICE WITH DISPOSABLE BATTERY MODULE, and Ser. No. 13/424,242, titled BATTERY MODULE FOR PERPENDICULAR DOCKING INTO A CANAL HEARING DEVICE, incorporated herein in their entirety by this reference.

BACKGROUND

The ear canal 10, as illustrated in FIG. 9, is generally narrow and tortuous and is approximately 26 millimeters (mm) long from the canal aperture 11 to the tympanic membrane. The lateral part 12 is referred to as the cartilaginous canal due to the underlying cartilaginous tissue. The medial part, proximal to the tympanic membrane, is rigid and referred to as the bony region 13 due to the underlying bone tissue. The dimensions and contours of the ear canal vary significantly among individuals. There is a characteristic "S" shape with a first and second bends generally occurring at the aperture area 11 and junction area 8, respectively.

Canal dimensions vary significantly along the ear canal and among individuals.

Placement of a canal hearing device inside the ear canal 10 and concha region 5 can be challenging due to difficulty in access and manipulation of a miniature canal device, particularly when placed deeply inside the ear canal. However, it is generally desirable to place a hearing device deep inside the ear canal for achieving various advantages including reduction of the acoustic occlusion effect, improved energy efficiency, reduced distortion, reduced receiver (speaker) vibrations, and improved high frequency response. A well-known advantage of deep ear canal placement is aesthetics as many hearing-impaired individuals refuse to wear visible hearing devices such as in-the-ear (ITE) or behind-the-ear (BTE) types.

SUMMARY

The present disclosure describes systems and handheld tools for removing a canal hearing device which has been inserted into the ear canal. An example system includes a handheld removal tool and a low profile knob handle structure incorporated with the canal hearing device. The removal tool may comprise a hand piece and a removal loop, in which the removal loop comprises a wide section with a relatively wide opening at the center, and a relatively narrow section for capturing the knob handle and pulling the hearing device attached thereto. The placement over the knob handle of the hearing device within the wide section of the removal tool and interlocking within the narrow section is performed tactually, or "blindly," without visual observation of the device.

The removal loop may be preferably made of thin metal wire to minimize interference with the knob handle and interference with the ear canal walls at the concha or the aperture region of the ear canal during the removal of the canal hearing device. The diameter of the loop wire is preferably less than approximately 0.25 mm, representing a small percentage of the diameter of the wide loop section at its widest point to minimize interference with the knob handle and the ear. The shape and dimensions of the removal tool, with respect to the knob handle, allow for self-centering within the concha region or the ear canal and for "blind" placement and interlocking with the knob handle. The removal loop may be made of a single formed wire to maximize durability, minimize interference volume, minimize cost of fabrication, and provide safe contact with the walls of the ear canal by virtue of closed loop contoured design.

The wide section of the removal loop may be substantially wider than the knob handle dimensions for readily positioning over it and within. The wide section is configured to guide and transition the knob element towards the narrow section for capturing the knob element within the narrow section upon an application of minimal force in the appropriate direction according to the specific design. The narrow loop may be made marginally narrower than the knob portion of the knob handle, but wider than the shaft portion of the knob handle thus allowing the shaft to glide into the narrow section of the removal loop. The narrow loop is configured to capture the knob handle, thereby allowing the removal tool to pull the hearing device upon applying force generally in the lateral direction (e.g., away from the ear canal). In some examples, the wide loop section diameter is in the range of about 4 mm to about 7 mm and the narrow loop section is in the range of about 1.5 mm to about 2.5 mm, smaller than the knob portion of the handle but wider than the shaft portion of the knob handle to ensure capture and locking. The knob handle in one embodiment is oriented at an angle between about 25 and 35 degrees with respect to axial orientation of the lateral portion of the hearing device, by following the natural contours of the ear canal including the concha cavity, to minimize interference with the walls of the ear canal and provide engaging access for the removal tool. The length of the low profile knob handle may be generally in the range of about 3 to 5 mm and its shaft is in the range of about 0.7 mm to about 1.5 mm.

After capturing the knob handle and removing the device from the ear canal, the removal tool can readily disengage from the hearing device upon pulling the knob handle away from the narrow section and into the wide section.

In some examples, the removal loop may be generally angled or curved with respect to the handle piece to facilitate engagement of the removal loop with the knob handle when the person is holding the hand piece towards the ear canal. In one embodiment, the removal loop may be configured in the shape of a keyhole having a wide diameter section and a narrow diameter section. In one embodiment, the removal loop is retractable within the hand piece to protect the removal loop element when not in use. In another embodiment, the removal tool is a part of a multi-purpose tool kit for use with the canal hearing device.

The design of the removal tool and knob handle system may provide ease of use, particularly for the hearing impaired individuals with poor dexterity, poor vision and generally difficulty in handling and removing a miniaturized canal hearing device. The design of the removal tool and knob handle system in accordance with examples of the present invention also may allow for alternate grasping of the knob handle, such as directly by fingers to remove the hearing device without resorting to the removal tool. Examples of the present invention may optionally be configured to remove standard CIC removal strands.

Some advantages of examples of the present invention are described herein to facilitate understanding of the disclosure. It is to be understood that not all embodiments of the present invention may enjoy all, or even any, of the described advantages.

BRIEF DESCRIPTION OF THE DRAWINGS

The above and still further objectives, features, aspects and attendant advantages of the present invention will become apparent from the following detailed description of certain preferred and alternate embodiments and method of manufacture and use thereof constituting the best mode presently contemplated of practicing the invention, when taken in conjunction with the accompanying drawings, in which.

DETAILED DESCRIPTION OF PREFERRED EMBODIMENTS

Certain details are set forth below to provide a sufficient understanding of embodiments of the invention. However, it will be appreciated by one skilled in the art that some embodiments may not include all details described. In some instances, well-known structures, hearing aid components, circuits, and controls, have not been shown in order to avoid unnecessarily obscuring the described embodiments of the invention.

Figure 10:
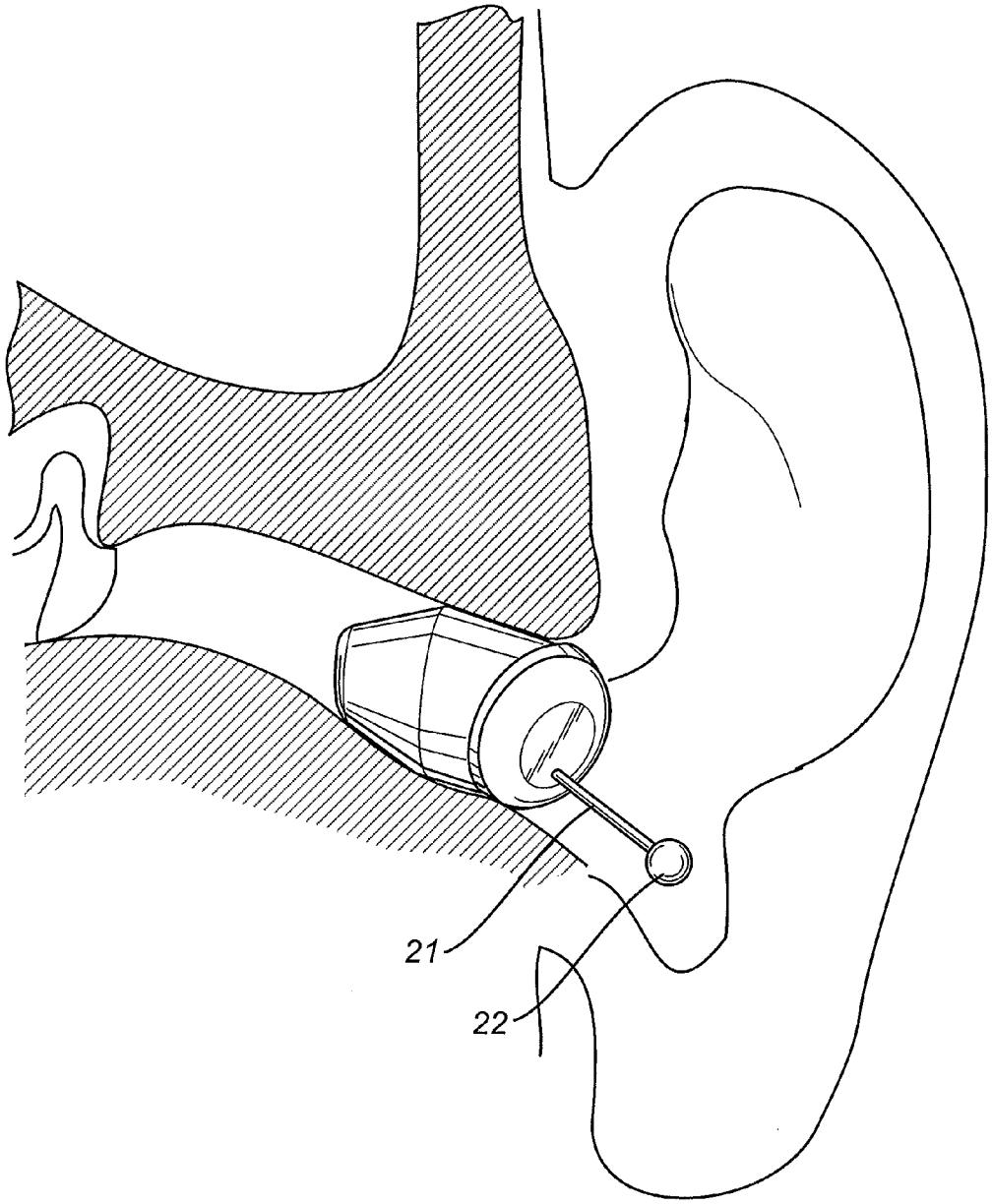
FIG. 10 is a view of a conventional canal hearing device (CIC) with a removal strand for manual grasp.

Canal hearing devices, such as a Completely-In-the Canal (known as CIC as shown in FIG. 10), are typically equipped with a handle including a removal strand 21 with knob structure 22. However, the design of the removal strand 21 and knob 22 is highly paradoxical since longer or prominent implementations are easier to handle but are generally more visible thus less desirable. On the other hand, a lower profile handle (e.g., 21 and 22) is aesthetically more desirable but more difficult to grasp for manipulating the device into and out of the ear canal, particularly for individuals who may have poor dexterity, large fingers, or poor vision. For deep canal placement, one can imagine the difficulty of inserting two fingers in the concha region 5 (FIG. 5), or at the aperture 11, or beyond inside the ear canal. Various handheld tools for removal of canal devices have been proposed and implemented with limited degree of success in the marketplace.

Figure 1:
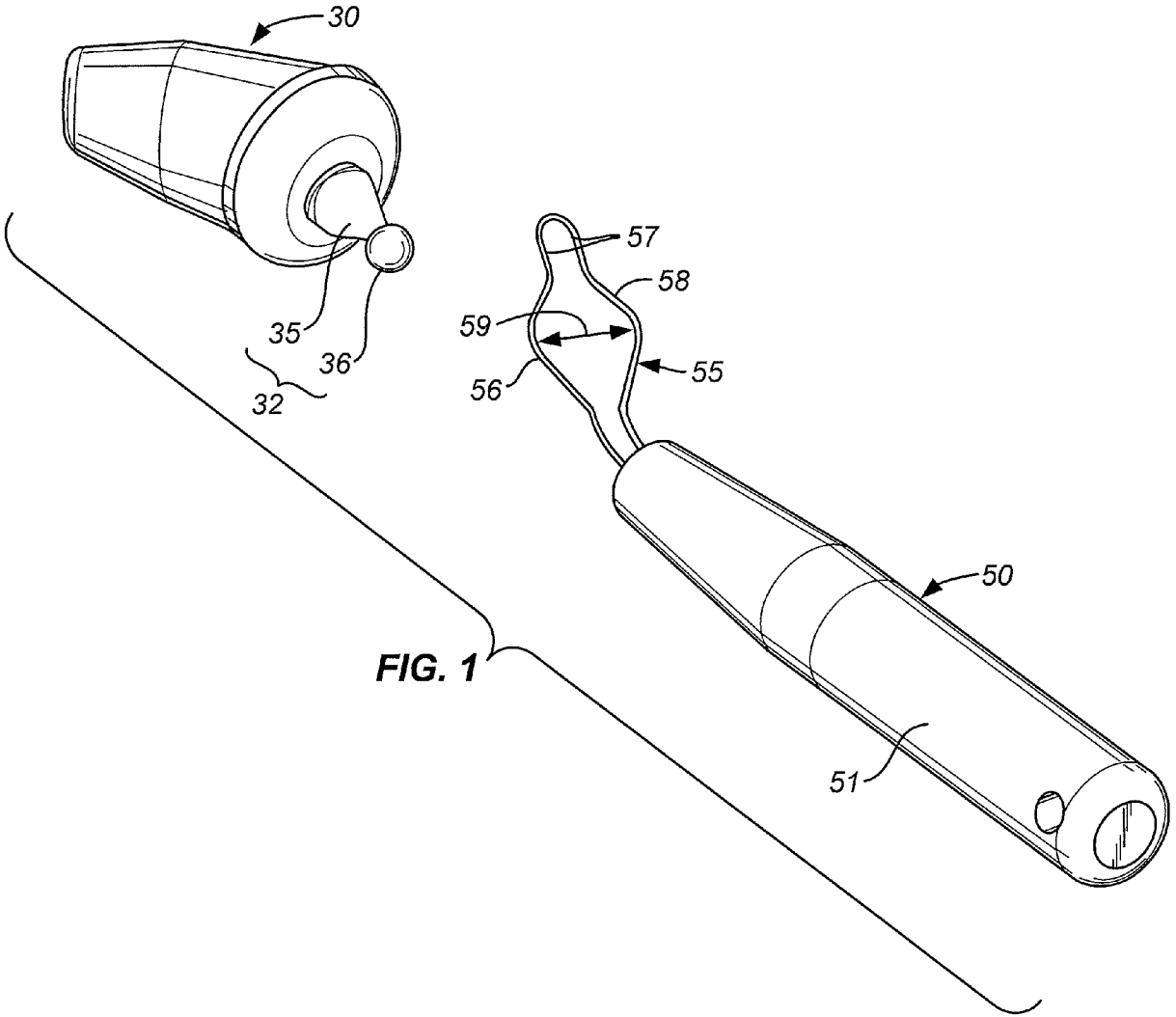
FIG. 1 is an exemplary view of the removal tool and knob handle structure of a canal hearing device.

FIG. 1 shows an exemplary system for removing a canal hearing device from the ear canal. Systems according to examples of the present disclosure may include a removal tool for engagement with a knob handle structure incorporated with a canal hearing device. The removal tool may be configured to engage with the knob handle as will be further described. For example, and referring to FIG. 1, a system may include a removal tool 50, which may have a hand piece 51 and a loop element 55 (e.g. a removal loop), and a knob handle 32 of a canal hearing device 30. The knob handle 32 may include a shaft portion 35 (e.g. shaft element) and a knob portion 36.

The knob handle 32 may be attached to substantially any canal hearing device designed for wear within the ear canal by techniques known in the art, such as gluing, fastening, or otherwise affixing. In some examples, the knob handle may be oriented at an angle between 25 and 35 degrees with respect to an axial direction of a lateral portion of the hearing device. In some examples, the knob handle 32 may be integral with the enclosure or casing of the canal hearing aid 30, in that the knob handle or portions of the knob handle may be formed during the fabrication of the canal hearing aid enclosure. Any known technique for forming the knob handle, individually or integrally with the enclosure of the hearing device, may be used such as molding, thermoforming, vacuum forming, or others.

In some examples, the shaft portion (e.g. shaft element) 35 of the knob handle 32 is attached to the canal hearing aid at one end, and attaches to a knob portion 36 at an opposite end. The shaft portion 35 may be an elongated member which may be generally cylindrical in shape, or it may be of a conical configuration. A wider end of a conically shaped shaft portion 35 may attach to the canal hearing device 30, while a narrower portion attaches to the knob portion 36 to facilitate engagement with the loop element 55 of the removal tool 50 as will be further described. As will be appreciated, the exact form factor of the shaft portion 35 is not limited to the examples described or shown in the figures and the shaft portion 35 may have any suitable shape or configuration for interlocking with a removal loop (e.g. loop element) 55 of removal tools according to the present disclosure.

The knob portion 36 may be a generally spherical structure which is mounted to an end of the shaft portion 35. In some examples, the knob portion 36 may be shaped as a cube (preferably with rounded corners to prevent injury to the walls of the ear canal), an oval structure, or other suitable form factor configured to fit through and interlock with the loop element 55.

As will be appreciated, and as will be further discussed with reference to conventional devices, examples of the present invention, shown in FIGS. 1-9, may provide an inconspicuous and low cost handle structure 32 (e.g. a knob handle) and a removal tool 50 for a canal hearing device 30, which canal hearing device may be worn inserted deeply inside the ear canal 10. As mentioned above, example systems may include a hand held removal tool 50 and a low profile handle 32, referred to interchangeably herein as knob handle, which may be incorporated within the canal hearing device 30 or attached thereto.

Figure 7:
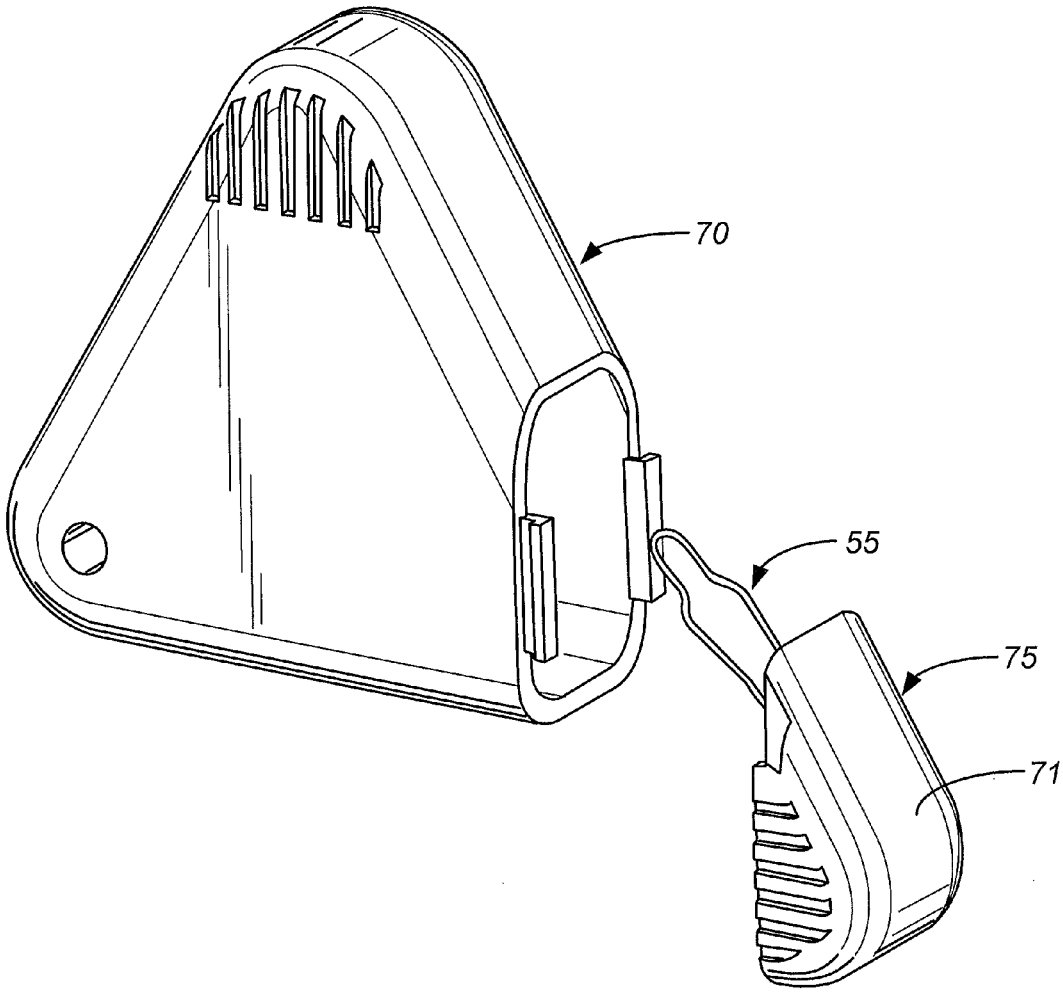
FIG. 7 is a view of an alternate embodiment of the removal tool as part of a multi-purpose tool kit.
Figure 8:
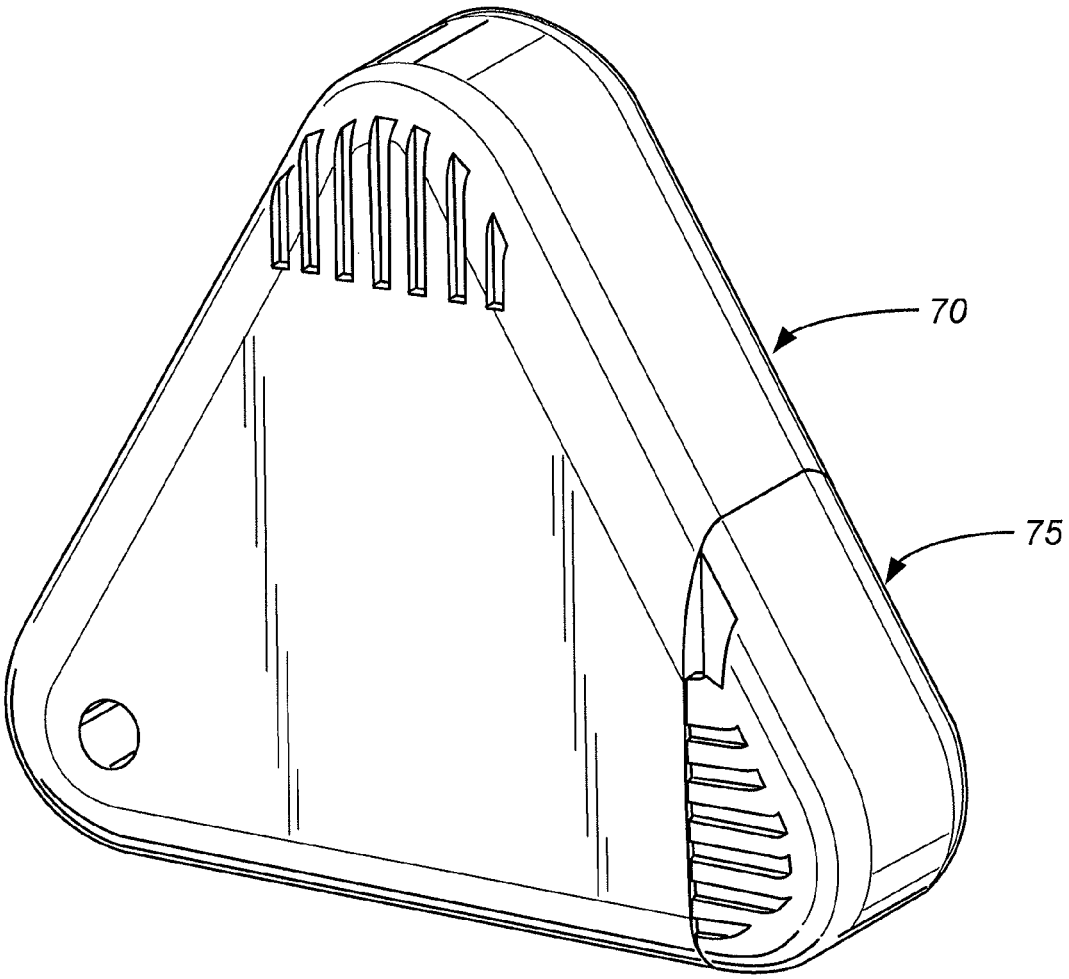
FIG. 8 is a view of the multi-purpose tool kit of FIG. 7 in the assembled state.

Referring again to FIG. 1, the removal tool 50 includes a hand piece 51 which is adapted for grasping by hand, and a removal loop 55 adapted for engaging and interlocking with the knob handle 32 during removal of the canal hearing device 30. The hand piece 51 may be implemented as a generally elongated structure, which may be shaped to fit comfortably within the hand of a user. Gripping surfaces and/or indent features may be included on one or more surfaces of the hand piece to enhance comfort and facilitate handling and manipulating of the removal tool by users having varying degree of manual dexterity. Other form factors may be used, such as, for example, the compact configuration shown in FIGS. 7-8 depicting a removal tool which is part of a multi-purpose kit.

The removal loop 55 (e.g. loop element) may be implemented as a structure defining an aperture of varying widths, such that the knob portion 36 of the knob handle 32 may fit through a first section of the aperture, while being unable to pass through a second section of the aperture.

Figure 2:
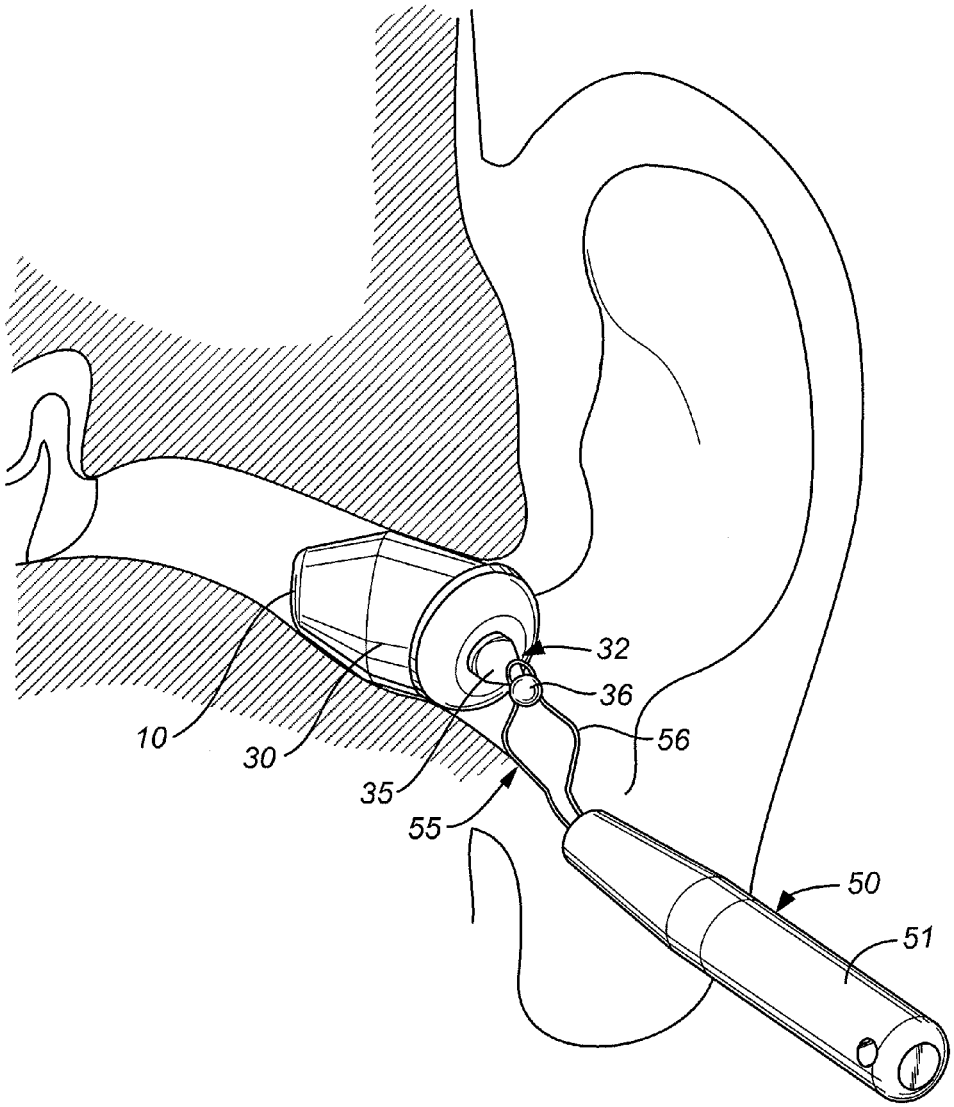
FIG. 2 is a view of the exemplary removal tool engaged with the canal hearing device during its removal from the ear canal.

In one example, the removal loop 55 (e.g. loop element) includes a wide section 56 with an opening 59 which is sized to be placed over and allow the knob portion 56 to fit through the opening 59. The loop 55 also includes a narrow section 57 for capturing the knob handle 32 therein and pulling the hearing device 30 attached thereto from the ear canal 10. The narrow section 57 of the removal loop 55 has a width (or diameter) which is wide enough to allow an end portion of the shaft 35 to fit through the opening but narrow enough to prevent the knob portion 36 from passing through. In this manner the removal loop 55 is able to engage and interlock with the knob handle to allow the user to apply a force to the knob handle without manually pulling on the knob handle 32 itself, as shown in FIG. 2. In some examples, the wide section 56 may be closer to the hand piece 51 than the narrow section 57, and a generally downward motion may be used to capture the knob and interlock the knob within the narrow section 57 located at the end portion of the loop 55. Other features, for example using a curved or angled loop element 55 relative to the hand piece, as will be further described, may further enhance the ease of engaging the knob handle 32 of the hearing device with the removal tool 50. As will be appreciated, the placement of the knob handle 32 within the wide opening 59 and interlocking within the narrow section 57 can be performed tactually or "in the blind" by the user without resorting to visual observation.

Figure 3:
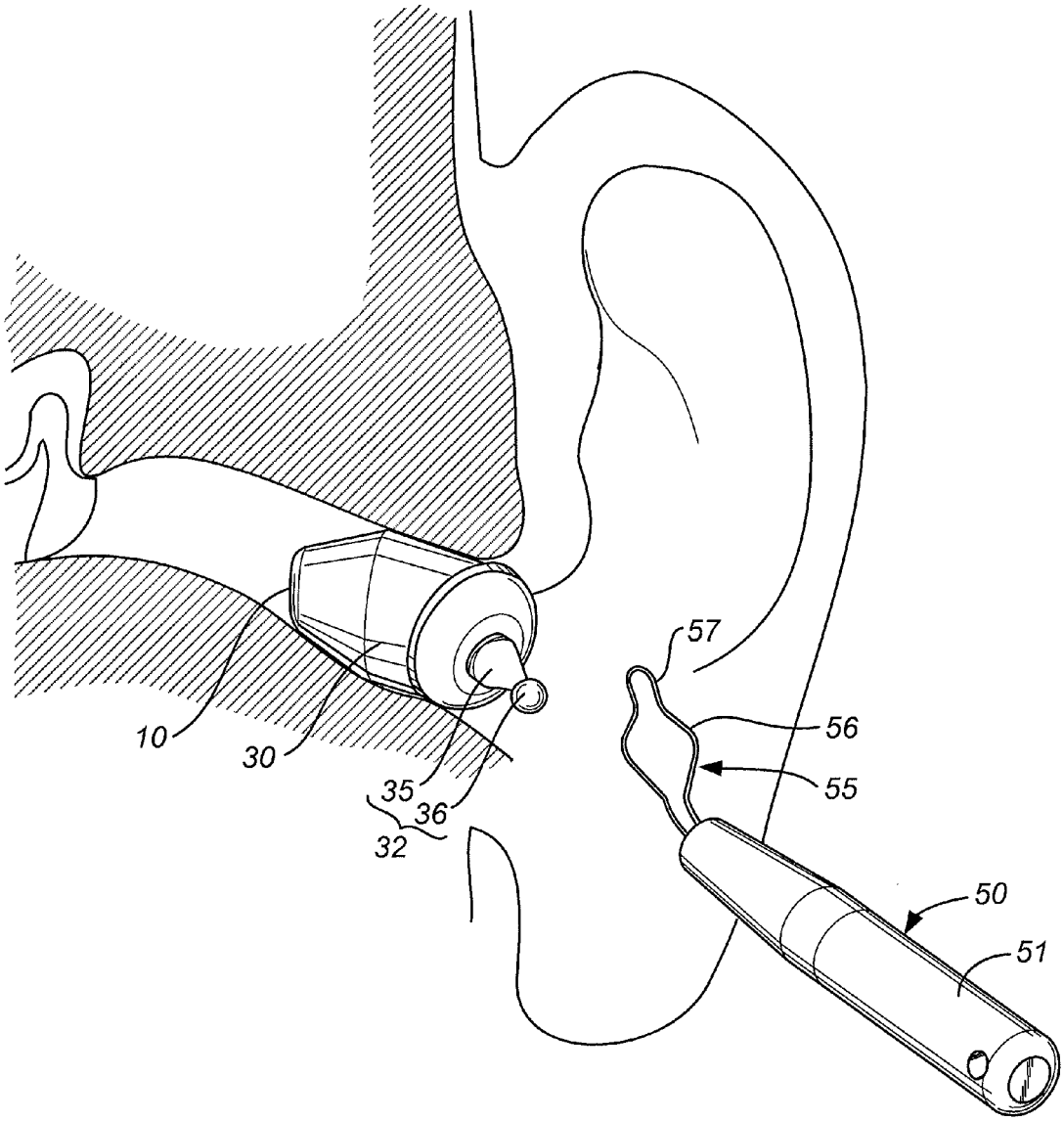
FIG. 3 is a view of the removal tool approaching the ear canal for removal of the canal hearing device.

FIGS. 2 and 3 show an exemplary removal tool during different stages of the process of removing a canal hearing device using the removal engagement tool described with reference to FIG. 1. FIG. 2, for example, shows the removal tool 50 engaged with the canal hearing device 30 placed in generally the medial portion 10 of the ear canal during its removal of the device 30 from the ear canal. FIG. 3 shows the removal tool 50 approaching the ear canal for removal of the canal hearing device 30 as described herein. In FIGS. 2 and 3, the removal tool 50 and canal hearing device 30 may include similar components as described with reference to FIG. 1. Therefore, in the interest of brevity, similar components of the removal tool 50 and canal hearing device 30 have been provided with the same reference numbers, and an explanation of their structure and/or function will not be repeated.

Figure 4:
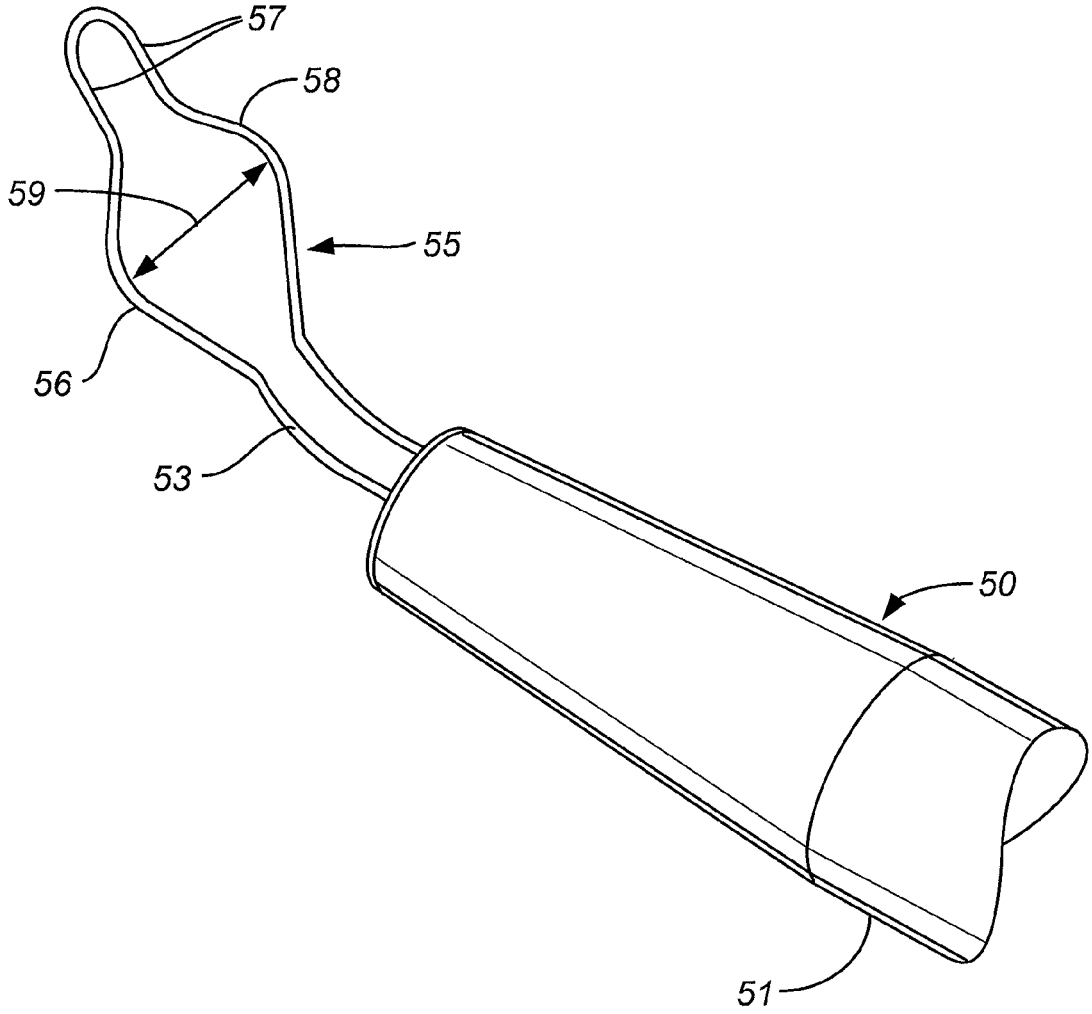
FIG. 4 is a detailed view of the removal loop structure.

FIG. 4 shows a detailed view of an exemplary removal loop structure according to the present disclosure. In some examples, the removal loop 55 may be made or a single metal wire formed in the desired shape, for example shaped as a keyhole, as will be further described. The removal loop 55 is preferably made of thin metal wire 53, which may serve to minimize interference with the knob handle 32 as well as ear canal walls at the aperture 11 or the concha 5 regions (FIG. 9) of the ear canal 10 during the removal process. For example, it may generally be desirable to minimize the discomfort of the individual using the canal hearing device as well any discomfort resulting from manipulating the device in and out of the ear canal. By minimizing the thickness of the wire 53, less material may need to be inserted into the small clearances available within the ear canal and manipulated inside the ear canal during the removal process. In some examples, the diameter of the loop wire 53 is preferably less than about 0.25 mm, representing a small percentage of width increase, less than 5% of the diameter of the wide loop section 56 at its widest point 59, thereby minimizing interference within the limited space inside the ear. The shape and dimensions of the removal tool 50, with respect to the knob handle 32, allows for self-centering of the removal loop 55 within the concha region 5 for "blind" engagement and interlocking with the knob handle 32. The removal loop 55 is preferably made of a single formed wire 53 which may maximize durability, minimize interference volume, minimize cost of fabrication, and provide safe contact with the walls of the ear canal by virtue of a contoured closed loop design as shown in FIGS. 1-5. Examples of suitable metal wire include stainless steel and other corrosion-resistant metal alloys. Other materials known in the art or later developed may be used for forming the removal loop 55. Other dimensions may also be used.

The wide section 56 of the removal loop 55 may be wider than knob portion 36, preferably by a margin exceeding 2 times, for readily placing the knob within the wide opening 59 of the removal loop 55. The wide section 56 is also configured to guide and transition of the shaft portion 35 of knob handle 32 towards the narrow section 57 via transition segment 58 (FIGS. 1 & 4) for capturing the knob handle structure 32 within the narrow section 57 upon the application of minimal force in the direction of narrow section 57. The width or diameter of narrow loop 57 (alternatively referred to herein as narrow section) at its center is made marginally smaller than the diameter of the knob portion 36, but wider than the top end of the shaft portion 35, thus allowing the shaft 35 to glide into the narrow section 57 from the transition segment 58. The narrow loop 57 is configured to interlock with the knob handle 32 by engaging with the shaft 35 from one side and the knob portion 36 from the other side, as shown engaged in FIG. 2. When interlocked with the knob handle 32, the removal tool 50 may be used to pull the canal hearing device 30 upon applying generally a lateral force (e.g. away from the ear canal).

Figure 9:
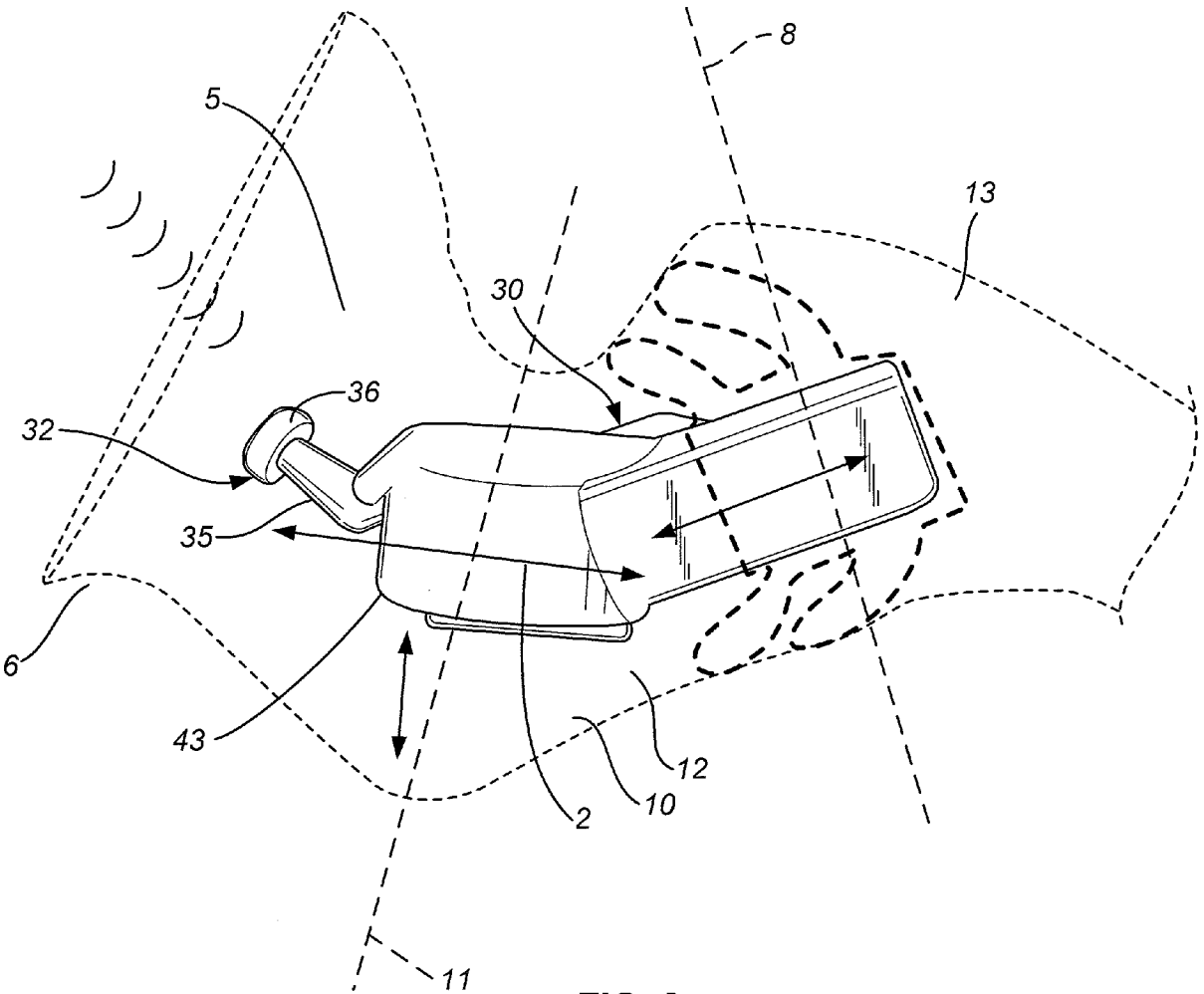
FIG. 9 is a solid model top view of the canal hearing aid device disposed inside an ear canal and illustrating general positioning and orientation of the knob handle inside the ear canal, the angle of the knob handle within the concha region, as examples.

In the preferred embodiments, the wide loop section 56 diameter is in the range of about 4 to 7 mm which is wider than the knob which is preferably in the range of about 1.6 mm to about 2.6 mm. However, the narrow loop section 57 is designed in the range of about 1.5 mm to about 2.5 mm at its center, barely smaller than the knob portion 36 to ensure capture and interlocking of the knob handle 36 therewithin. In one embodiment, the knob handle 32 is oriented at an angle between about 25° and 35° with respect to axial orientation 2 (FIG. 9) of the lateral portion 43 of the hearing device 30, essentially following the natural contours of the ear canal 10 including the concha cavity 5 behind the tragus 6, to minimize interference of the knob handle 32 with the walls of the ear canal, and provide engaging access for the removal tool 50 in the ear. The length of the knob handle 32, including the shaft 35 and knob 36, is relatively short compared to standard CIC strands, the length of the knob handle 32 being in the range of about 3 mm to about 5 mm. This length constitutes generally less than ⅓ of the total length of the canal hearing device as shown in FIG. 9, instead of generally 50% or more of the device length as in conventional CIC devices shown in FIG. 10. The shaft diameter at the narrowest segment is preferably in the range of about 0.7 mm to about 1.5 mm to fit readily within the narrow section 57 of the removal loop 55. In the preferred embodiments, the shaft portion 35 is laterally tapered as shown in FIGS. 1-4. After capturing the knob handle 32 and removing the hearing device 30 from the ear canal, the removal tool 50 can readily disengage from the hearing device 30 by pulling the knob handle 32 away from the narrow section 57 and into the opening 59 of the wide section 56.

Conventional canal hearing aids of the prior art typically rely on a strand structure to remove the device form the ear canal. The strand, sometimes referred to as extraction cord, is typically made of clear monofilament (e.g. nylon or a fishing line) and is attached laterally to the body of the device as shown in FIG. 10. The strand also has a knob-like structure and the combined length is typically more than about 5 mm in order to allow the user to manually grasp it by fingers to remove the canal hearing device from the ear canal. This and similar types of removal strands have been employed in the hearing aid industry for decades and such conventional removal strands may be disadvantageous for variety of reasons. For example, some disadvantage may include the added cost of custom fabrication of such a strand, as well as the visibility of the strand since the strand material is typically made of monofilament, or like material, which is different in color and texture from the canal hearing device attached thereto, thus visibly standing out from the lateral surface of the canal hearing device. In contrast, the knob handle 32 of the present invention is preferably molded with the housing of the canal hearing device, thus offering a more cost effective monolithic part as shown in FIGS. 1-4 and FIG. 9. In other prior art designs various other solutions, such as flexible loop structures, have been employed, however such flexible structure may create substantial design and manufacturing challenges, as well increase the cost of the hearing device. Furthermore, a single-ended hook (e.g. open hook design) may be more prone to bending and deforming. In contrast, examples of the present invention in utilize a removal loop with a closed-loop wire structure, which may be more durable and less prone to bending and deformity.

Figure 5:
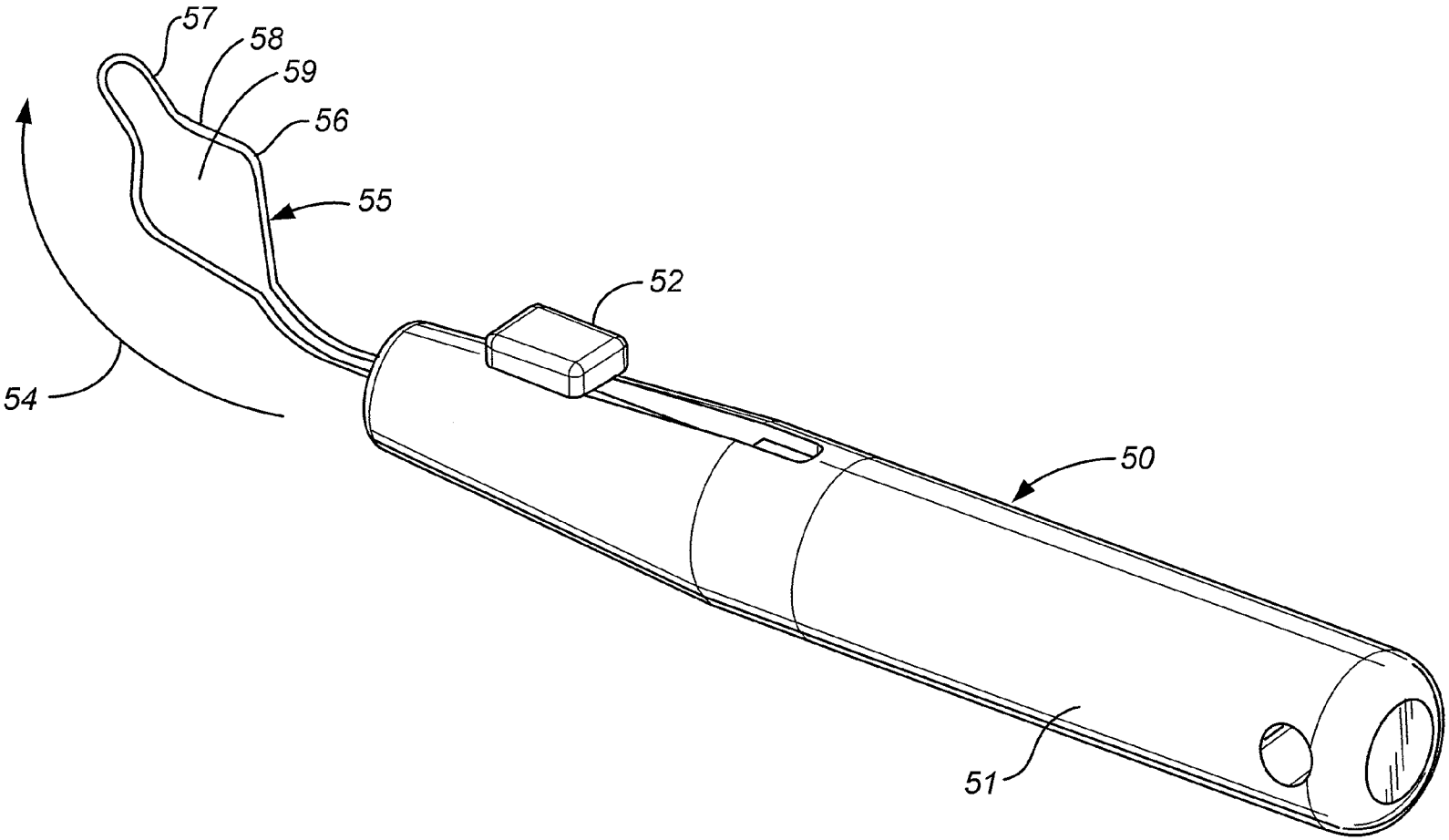
FIG. 5 is a view of an alternate embodiment of the removal tool with a retractable and curved loop for improved engagement with the knob handle structure of the canal hearing device. The removal loop is shown extended and ready for engagement with the knob handle structure (not shown).
Figure 6:
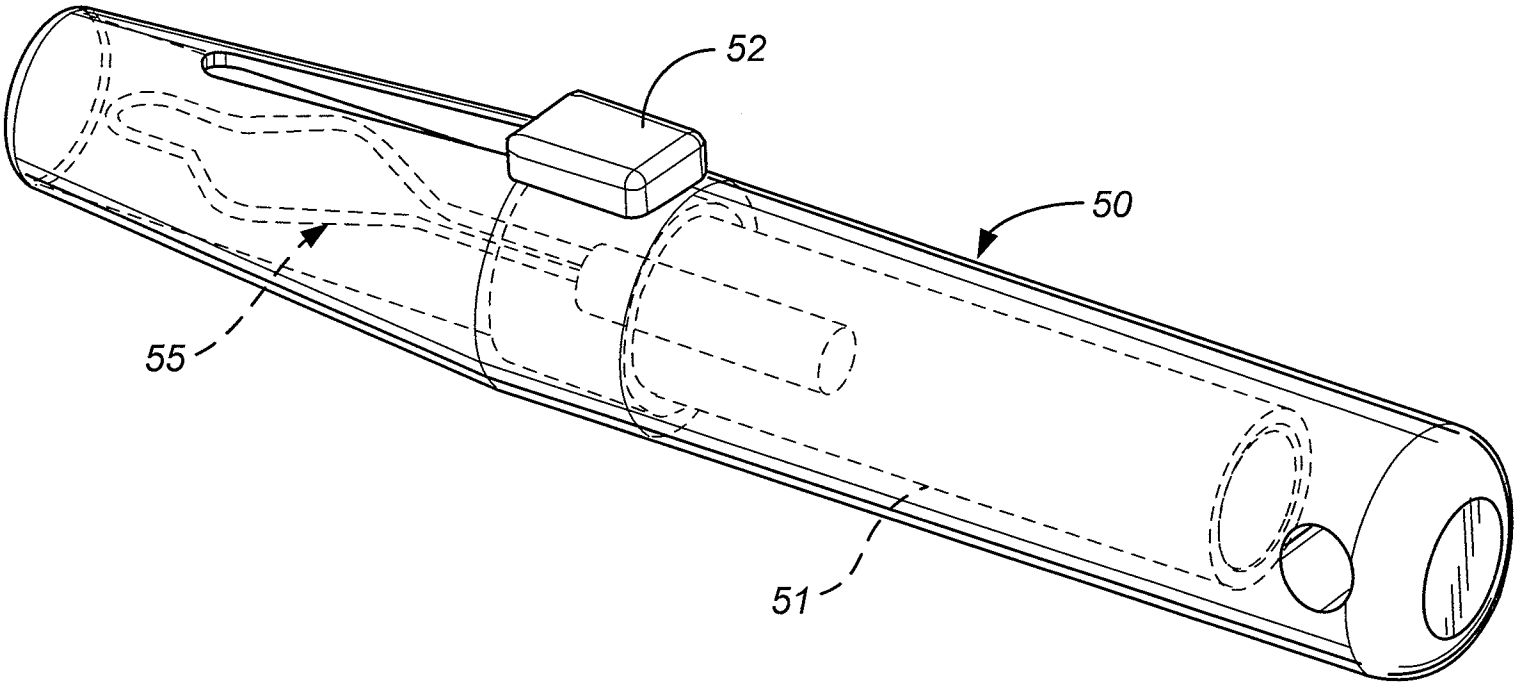
FIG. 6 is a view of an alternate embodiment of the removal tool with the retractable loop of FIG. 5, shown with the removal loop retracted within the removal tool.

FIG. 5-6 show another example of a removal tool 50 according to the present invention which includes a retractable loop element (e.g. removal element) 55. In FIG. 5, the removal tool 50 is shown with the loop element extended, and in FIG. 6, the removal tool 50 is shown with the loop element 55 retracted within the body of the hand piece 51. Retractable loop elements can be implemented using a variety of conventional mechanisms, such as sliders, as is further described below. In some examples, the removal loop 55 may be generally angled with respect to the hand piece 51 (as in FIGS. 1-4) or curved (as in the direction of 54 as shown in FIG. 5) to facilitate engagement of the removal loop 55 with the knob handle 32 when the person is holding the hand piece towards the ear canal as shown in FIG. 3. In this embodiment, the loop element is angled approximately between 35 and 55 degrees with respect to an axial orientation of the hand piece element. In some examples, depicted in FIGS. 1-5, the removal loop 55 is configured in the shape of a keyhole having a wide diameter section 56 and a tapered narrow section 57. In one embodiment, the removal loop 55 is retractable within the hand piece 51 (FIGS. 5 & 6) to protect the removal loop 55 when not being in use. The retraction can be made by a number of known methods including a sliding lever 52 as shown in FIGS. 5 & 6. In another embodiment shown in FIGS. 7 & 8, the removal tool 75 is part of a multi-purpose tool kit 70 for use with other tools (not shown) for the canal hearing device.

In the example shown in FIGS. 7-8, the removal loop (e.g. loop element) 55 is attached to a hand piece 71 of the removal tool 75, the hand piece forming part of the enclosure of the multi-purpose tool kit 70. In this manner, by enclosing the removal loop 55 within the enclosure of the multi-purpose tool-kit, the removal loop 55 may be protected from damage when not in use.

The examples of systems and methods for removal of canal hearing devices may offer numerous advantages, some of which have been described and others will be appreciated by those skilled in the art in light of the present disclosure. Example systems, which may include a removal tool 50 and knob handle 32, may provide ease of use, particularly for the hearing impaired individuals with poor dexterity, poor vision and generally difficulty in handling and removing a miniaturized canal hearing device 30 from the ear canal 10. Described examples may also allow persons with good dexterity and access to grasp the knob handle 32 directly by fingers to remove the hearing device without resorting to the removal tool. Furthermore, the removal tool 50 may optionally be configured to remove standard CIC products which use longer removal strands incorporating a ball on the tip as shown in FIG. 10. Therefore, the removal tool 50 may function with specific canal hearing devices, such as deep canal types whereby access to the device is difficult or not possible, as well as standard or less invasive devices whereby the lateral end of the device may be accessible for some, but difficult for due to personal limitations, such as large fingers, poor dexterity, dementia, etc.

Although examples of the invention have been described herein, it will be recognized by those skilled in the art to which the invention pertains from a consideration of the foregoing description of presently preferred and alternate embodiments and methods of fabrication and use thereof, that variations and modifications of this exemplary embodiment and method may be made without departing from the true spirit and scope of the invention. Thus, the above-described embodiments of the invention should not be viewed as exhaustive or as limiting the invention to the precise configurations or techniques disclosed. Rather, it is intended that the invention shall be limited only by the appended claims and the rules and principles of applicable law.

What is claimed is:

1. A removal tool for removing a canal hearing device from the ear canal, comprising:

a hand piece element adapted for manual grasp; and a loop element defining an aperture having a first section and a second section, the first section being wider than the second section, wherein the first section is adapted for placement over a knob handle attached to the canal hearing device and is configured to guide the knob handle from the first section into the second section for interlocking the knob handle within the second section for removing the canal hearing device from the ear canal.

2. The removal tool of claim 1, wherein the loop element is made of a single formed metal wire.

3. The removal tool of claim 2, wherein the metal wire has a diameter of less than about 0.25 mm.

4. The removal tool of claim 1, wherein a width of the first section is in the range of about 4 to 7 mm.

5. The removal tool of claim 1, wherein a width of the second section is in the range of about 1.5 to 2.5 mm.

6. The removal tool of claim 1, wherein the loop element is angled approximately between 35 and 55 degrees with respect to an axial orientation of the hand piece element.

7. The removal tool of claim 1, wherein the loop element is curved.

8. The removal loop of claim 1, wherein the aperture of the loop element is in the shape of a keyhole.

9. The removal tool of claim 1, wherein the removal tool is part of a multi-purpose tool for use with the canal hearing device.

10. The removal tool of claim 1, wherein the loop element is configured for capturing and interlocking with the knob handle tactually.

11. The removal tool of claim 1, wherein the loop element is retractable within the hand piece element.

12. A method for removing a canal hearing device from the ear canal, the method comprising:

introducing a loop element of a removal tool towards the ear canal;

providing a first section of the loop element around a knob handle attached to the canal hearing device;

guiding the loop element relative to the knob handle to move a second section of the loop element into engagement with the knob handle, the second section being narrower than the first section; and removing the canal hearing device from the ear canal by moving the loop element away from the ear canal while the knob handle is engaged with the second section of the loop element.

13. The method of claim 12, wherein said providing the first section around the knob handle and said guiding the loop element relative to the knob handle are performed tactually and without visual observation.

14. A system for removing a canal hearing device from the ear canal, comprising:

a removal tool having a loop element comprising a first section and a second section, wherein the first section is wider than the second section; and a knob handle of a canal hearing device, the knob handle having a knob portion and a shaft element, wherein the first section of the loop element is adapted for placement around the knob handle, and is configured to guide the knob handle into the second section for interlocking within and for subsequently removing the canal hearing device from the ear canal.

15. The system of claim 14, wherein the loop element is made of a single formed metal wire.

16. The loop element of claim 15, wherein the metal wire has a diameter of less than about 0.25 mm.

17. The loop element of claim 14, wherein the first section includes a first rounded portion having a diameter in the range of about 4 to 7 mm.

18. The removal tool of claim 14, wherein the second section includes a second rounded portion having a diameter smaller than a diameter of the knob portion and wherein the diameter of the second rounded portion is in the range of about 1.5 to 2.5 mm.

19. The removal loop of claim 14, wherein the loop element is angled approximately between 35 and 55 degrees with respect to an axial orientation of a hand piece element.

20. The removal tool of claim 14, wherein the loop element is curved.

21. The removal tool of 14, further being a part of a multi-purpose tool for use with the canal hearing device.

22. The removal tool of claim 14, wherein the loop element is configured for capturing and interlocking with the knob handle without visual observation.

23. The removal tool of claim 14, wherein the loop element is retractable.

24. The removal tool of claim 14, wherein the loop element is in the shape of a keyhole.

25. The knob handle of claim 14, wherein the knob portion has a diameter in the range of about 1.6 mm to about 2.6 mm.

26. The knob handle of claim 14, wherein the shaft element is angled approximately between 25 and 35 degrees with respect to an axial direction of a lateral portion of the hearing device.

27. The knob handle of claim 14, wherein a length of the knob handle is in the range of about 3 mm to about 5 mm.

28. The knob handle of claim 14, wherein a diameter of the shaft element is in the range of about 0.7 mm to about 1.5 mm.

* * * * *